US009750385B2

(12) United States Patent
Curtis

(10) Patent No.: US 9,750,385 B2
(45) Date of Patent: Sep. 5, 2017

(54) HANDHELD SCRUBBING TOOL

(71) Applicant: Robert Curtis, Syracuse, NY (US)

(72) Inventor: Robert Curtis, Syracuse, NY (US)

( * ) Notice: Subject to any disclaimer, the term of this patent is extended or adjusted under 35 U.S.C. 154(b) by 0 days.

(21) Appl. No.: 15/214,511

(22) Filed: Jul. 20, 2016

(65) Prior Publication Data

US 2017/0164807 A1 Jun. 15, 2017

Related U.S. Application Data

(60) Provisional application No. 62/267,488, filed on Dec. 15, 2015.

(51) Int. Cl.

| | |
|---|---|
| ***A46B 5/02*** | (2006.01) |
| ***A47L 13/16*** | (2006.01) |
| ***A47L 13/42*** | (2006.01) |

(52) U.S. Cl.

CPC ..... *A47L 13/16* (2013.01); *A46B 5/021* (2013.01); *A46B 5/026* (2013.01); *A47L 13/42* (2013.01)

(58) Field of Classification Search

CPC A46B 5/02; A46B 5/021; A46B 5/026; A47L 13/16; A47L 13/42

See application file for complete search history.

(56) References Cited

U.S. PATENT DOCUMENTS

| | | | | |
|---|---|---|---|---|
| 6,261,164 | B1 * | 7/2001 | Rivard | A47L 11/164 451/353 |
| 8,656,547 | B2 * | 2/2014 | Zanetti | A47L 13/16 15/1.52 |
| 2015/0272308 | A1 * | 10/2015 | Harrington | A46B 5/0075 134/6 |

* cited by examiner

*Primary Examiner* — Randall Chin

(74) *Attorney, Agent, or Firm* — Bernhard P. Molldrem, Jr.

(57) ABSTRACT

A hand-held scrubbing tool is formed with an upper dome portion and an incorporated cylindrical base portion which has a predetermined diameter and a generally circular bottom surface. The tool is favorably formed of a comfortable, flexible urethane rubber material that has a durometer value of about 30 A. Hook type material is embedded into the bottom surface of the base portion and is adapted to permit a scrub pad, sanding pad, or the like to be secured to it. The tool may have a design with protruding, tactile features that facilitate a comfortable grip on the tool.

11 Claims, 7 Drawing Sheets

HANDHELD SCRUBBING TOOL

This application claims priority under 35 U.S.C. §119(e) of provisional application Ser. No. 62/267,488, filed Dec. 15, 2015, the disclosure of which is incorporated herein by reference.

BACKGROUND OF THE INVENTION

Within the janitorial and home cleaning products industries, many tools are manufactured for sale that are provided to users as handheld scrubbing devices. These tools often have a grippable handle, a base, and either a permanent or replaceable abrasive pad, scrub pad, or brush. The abrasive pad is typically attached to the base with a glue or cement. Also, the handle part is typically metal or a hard plastic, which can become uncomfortable to the hand after a period of scrubbing with the tool

OBJECTS AND SUMMARY OF THE INVENTION

This patent application will introduce a new tool to the market with a unique design, innovative choice of materials, and improved manufacturing process.

An object is to provide a comfortable grip for the user, with the capability of using a design or color to identify the tool.

Another object is to provide the tool with a means for easy change out of the abrasive pad.

A further object is to provide a scrub tool of this type having an open space on which can be printed or molded a logo, e.g., a space to accept a printed or molded-on logo, advertising, or promotional marketing content, permitting the scrub device to function in a way to market or promote a related or unrelated product or service.

GENERAL DESCRIPTION

The invention can best be described as a comfortable, hand-fitting cleaning or scrubbing tool that is dome shaped on the top with a cylindrical base a nominal 3.25 inches in diameter. This is most favorably formed of a comfortable, flexible urethane rubber, i.e. with a durometer value of about 30 A. The hardness or flexibility of the unit can vary within a range around the 30 A value. Overall height can be a nominal 2.25 inches. This dome-shaped member serves as a handle for the user to secure a full-palm grip. The base is round, favorably circular, with either grooves around the exterior to enhance grip, or a color change to enhance aesthetics, or both. A hook-and-loop material, typically the hook component, is embedded into the material at the base, and this is used to secure the pad to the unit. The pad may have loop material affixed to it, or may be of a material that readily attaches to the hook material.

Material

The tool is favorably made of urethane elastomer (urethane rubber). This rubber preferably will have a Shore hardness of 30 A on the durometer scale. This material is flexible, allowing the tool to flex inward as a user applies pressure with their grip, and yet remains comfortable in the hand during use. Attached to the base of tool, and as a permanent part of the tool, is a Velcro disc with exposed hooks. These hooks will be employed to grab the looped side of any abrasive substrate either that has loops as a characteristic or added in separately as a feature.

Design

There are several design styles that will be disclosed here to thoroughly convey that the tool may appear in a multitude of alternative embodiments.

DESCRIPTION OF THE PREFERRED EMBODIMENT(S)

Figure 1:
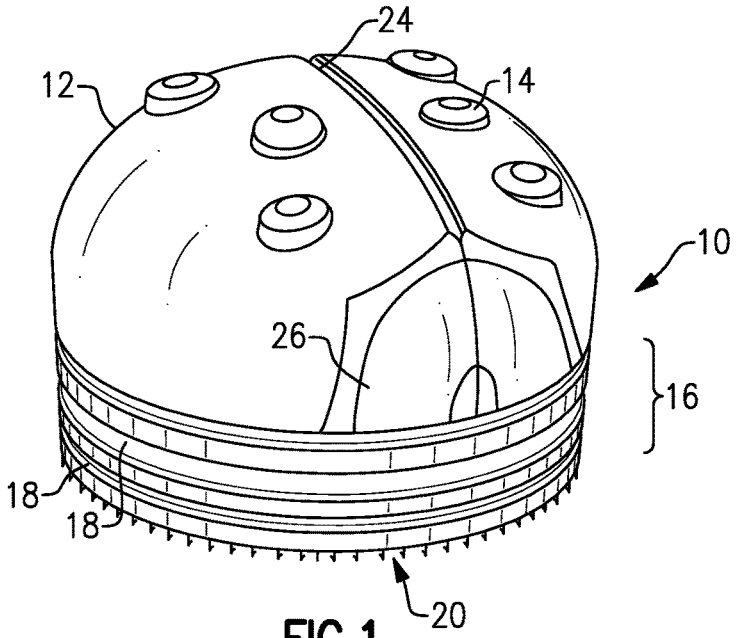
FIG. 1 is a perspective view of one preferred embodiment of the scrub tool of this invention.

The tool 10 of this invention may be created in any of a large number of designs and color schemes. For example, one design for the tool may be a straightforward dome shape that also involves the color scheme to include sports team/corporate brand/theme interest. There may two or more colors in the design. The top of the dome may be a team's primary or secondary color. The bottom one-third of the unit may be another primary color or a secondary color. With the ability to airbrush (paint) a team logo or letter, a team's identity can be shown clearly on the tool. Where license or permission is obtained for a particular sports team or school, the team colors and logo can be incorporated into the dome portion. This design flexibility also permits the tool to carry a particular corporate brand or color scheme as a way to help merchandise or promote a given product or service.

A Split-Design/Color and Different Bottom is another possible scheme. The manufacturing process has the ability to change colors to allow for creativity without relating to any brand or team concept. There are many different designs that can be applied to the dome and colors that can be varied on the bottom of the tool. The following are a few design schemes although many others are possible:

- Camouflage dome with fluorescent orange bottom
- Camouflage dome with brown or black bottom
- Orange and Black Stripes (Tiger design) on dome with a black base
- Black and white stripes on dome (Zebra stripes) with black or pink bottom Specific country flag, where dome and base may have a given country's flag's colors with a country's emblem or small flag molded or airbrushed on the center top Flower or creative pattern design on top of the dome with varied color bases Lemon/Lime: Unique structure, this unit has an exaggerated lemon/lime shape to reach the desired dimension of a nominal 3.25 inch base. This unit comes to a ⅛ inch diameter point to emulate the stem connection of a lemon. The texture of the unit is consistent with the peel of a lemon or lime and will be colored yellow for lemon with a green base; green for lime with a yellow or white base. For different size hands, the diameter may be approximately 3 to 3.5 inches.

Orange: This design is a dome shaped textured unit with also a 3.25 inch base, overall height of 2 inches with lines and a small circular mark to emulate the top of an orange. Orange peel texture exists on the unit, and when painted orange, has the appearance of the fruit.

Ladybug: This design has the addition of six small protruding circles 1/16 inch high and ⅛ inch diameter situated on the top of the dome and two rows parallel to one another and divided by a line splitting the unit in equal halves. Further additions have two oblong circles adjacent to one another on the side of the unit as to emulate the lady bug face. And two smaller oblong circles at the opposite side to represent the back end of a lady bug. This unit is made from urethane rubber, colored red for the top portion, and black on the bottom. The defining features for the circles, face and back end may be painted black.

Process

The scrubber units favorably are made of a two-stage pour of a urethane elastomer. The urethane elastomer has two parts: A and B. These parts are mixed in equal weight and volume and colored as desired. The top dome portion of all units are poured in the mold first at the desired color. After a time lapse suitable for partial cure, before the top portion is fully cured, the bottom portion is poured using equal parts A and B at the desired color for the bottom. Following a second time lapse, but before the bottom section is fully cured, the disk of hook-type Velcro (or equivalent hook-loop material) is added to the bottom of the unit. The material is pre-cut into a circular shape about 3 inches in diameter. Once cured, the tool is complete with the exception of any airbrush painting, stenciling or printing. Alternatively, the units can be made by injection molding, and may be made of alternative materials, e.g., thermoplastic urethane, TPE, or TPV, for example, Santoprene.

There are many tools on the market used as handheld scrubbing devices. This device is unique in that it is dome shaped, made with urethane rubber with Shore hardness of 30 A, allowing for a flexible, full-palm grip. The process by which the units are made is unique and allows fabrication of any or all the alternative embodiments listed. The scrub pads may be made of a suitable scrub material e.g. for removing grease and dirt from as surface. The pads may be of any of a variety of hardnesses depending on the intended use. The units may also be used in sanding, i.e., for woodworking, and sandpaper discs of various grits and grades may be made to attach to the base of the unit.

FIG. 1 shows a hand-held unit 10 according to one embodiment, here configured with a lady-bug or lady-bird beetle shape. The dome portion 12 is configured and colored as discussed before, and the buttons (i.e., projecting circles or discs) 14 on its surface may be molded to protrude outward, giving additional assistance in gripping without causing any discomfort. The base thereof 16 appears as a black disk, with one or more annular grooves 18 encircling it. These give the user's fingers a purchase for a better grip. A hook-and-loop material disc 20, here the hook component, e.g., the hook component of Velcro material, is embedded or affixed into the bottom surface of the base. This disc 20 could be another equivalent hook-type material.

Figure 2:
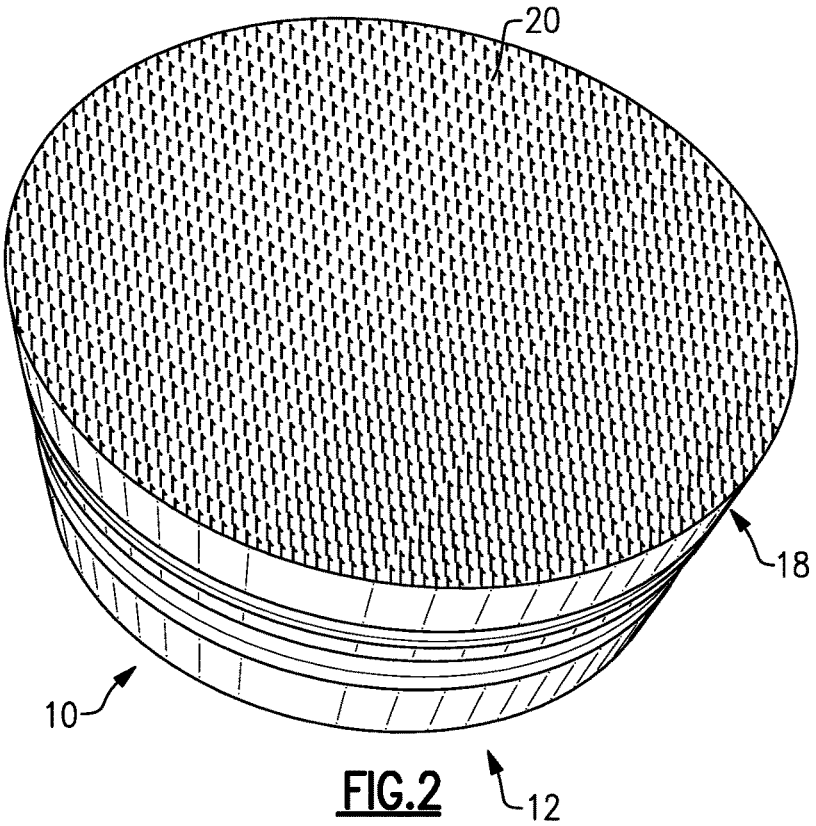
FIG. 2 is an inverted view thereof, showing the disk of hook-type material affixed onto the base or bottom side thereof.

FIG. 2 shows the unit 10 inverted, i.e., base upward, showing the disk 20 of Velcro hook material attached onto the base portion 16. Other hook structure could be substituted.

Figure 3:
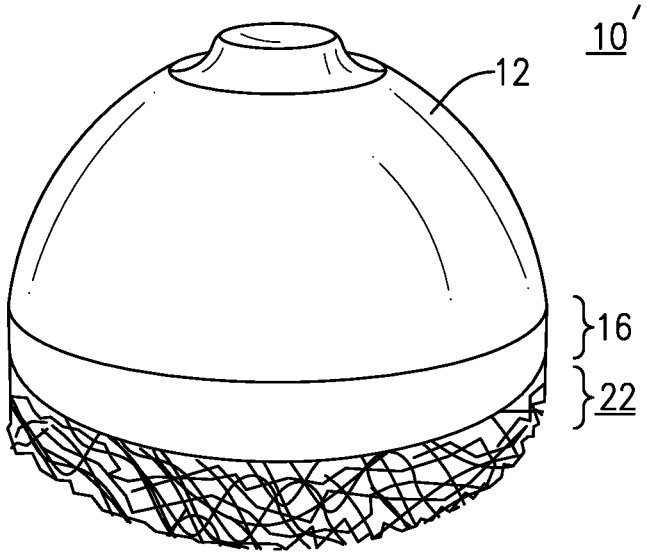
FIG. 3 is a side perspective view of another embodiment in the shape of a half lemon.

FIG. 3 shows an alterative embodiment of the unit 10', here with its dome portion 12 molded into the shape of a lemon or lime half. As with the prior embodiment, the base 16 is present beneath the dome portion 12. An abrasive scrub pad 22 is shown here attached to the tool. Here the pad 22 is formed of a fibrous material that readily attaches to the disk 20 of hook material, but can readily be peeled off. The pad 22 should be approximately the same shape and dimension as the base of the tool, e.g., a nominal 3.25 inches. The texture formed on the surface of the dome portion 12 both creates an appearance of lemon peel or lime peel, and its tactile structural nature also assists the user in grip without causing any discomfort.

Figure 4B:
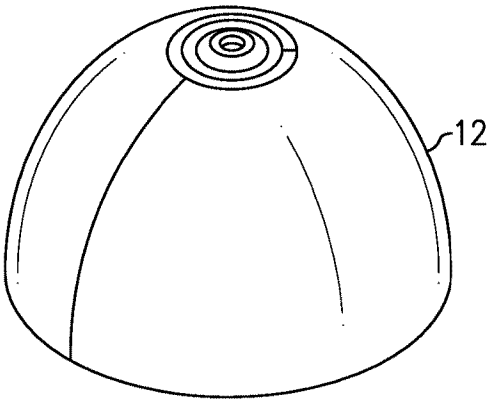
FIGS. 4A to 4D are a top plan view, perspective, side and front elevations of an embodiment in the shape of a half orange.
Figure 4D:
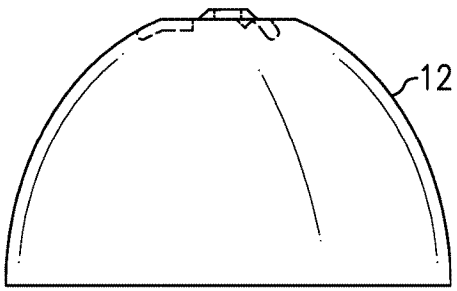
Figure 4A:
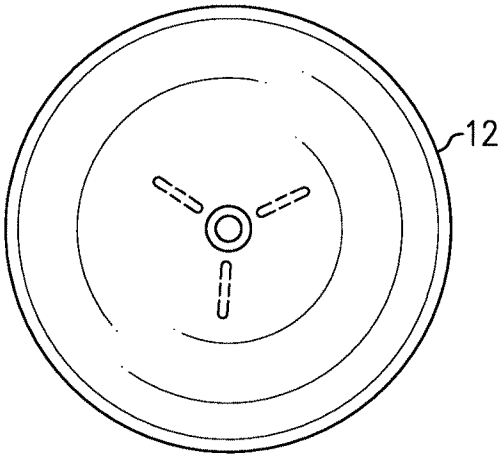
Figure 4C:
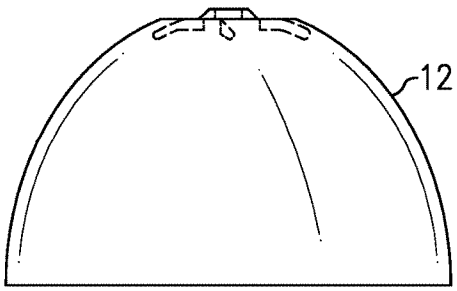
Figure 5B:
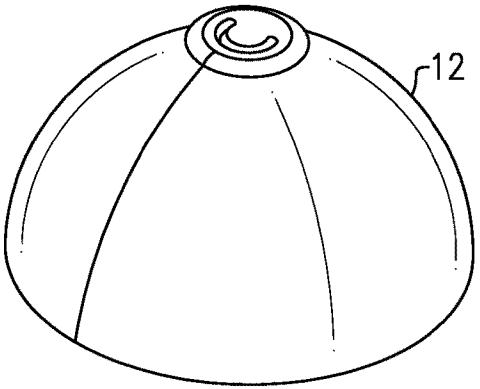
FIGS. 5A to 5D are a top plan view, perspective, side and front elevations of an embodiment in the shape of a half lemon.
Figure 5D:
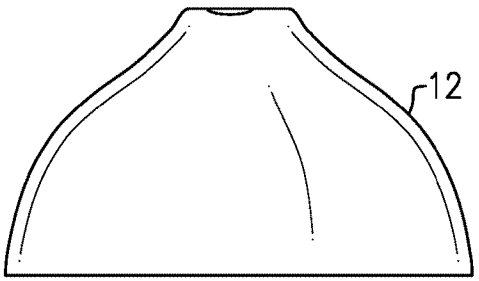
Figure 5A:
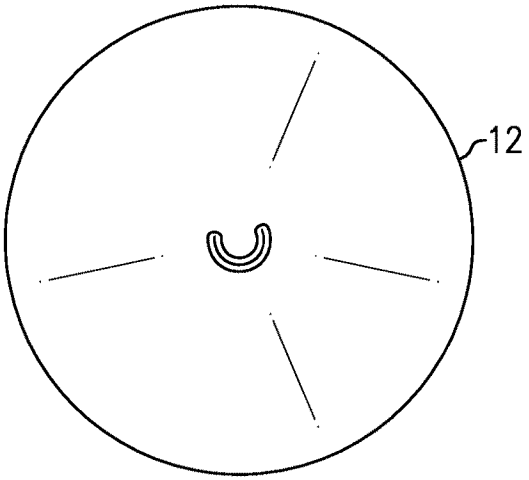
Figure 5C:
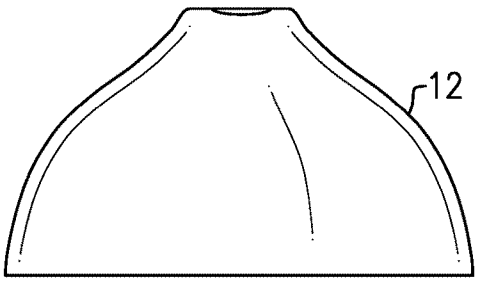

FIG. 4, composed of a plan view FIG. 4A, perspective FIG. 4B, side and front elevations FIG. 4C and FIG. 4D, illustrate the shape and overall design of the dome portion 12 in the shape of an orange, while FIG. 5, composed of a plan view FIG. 5A, perspective view FIG. 5B, side and front elevations FIG. 5C and FIG. 5D, illustrate the shape and overall design of the dome portion 12 in the shape of a lemon or lime. Preferably, these each are manufactured to the same diameter of base, here 3.25 inches. Variations of this may be taken, for example, to facilitate use by users with different hand sizes.

Figure 6:
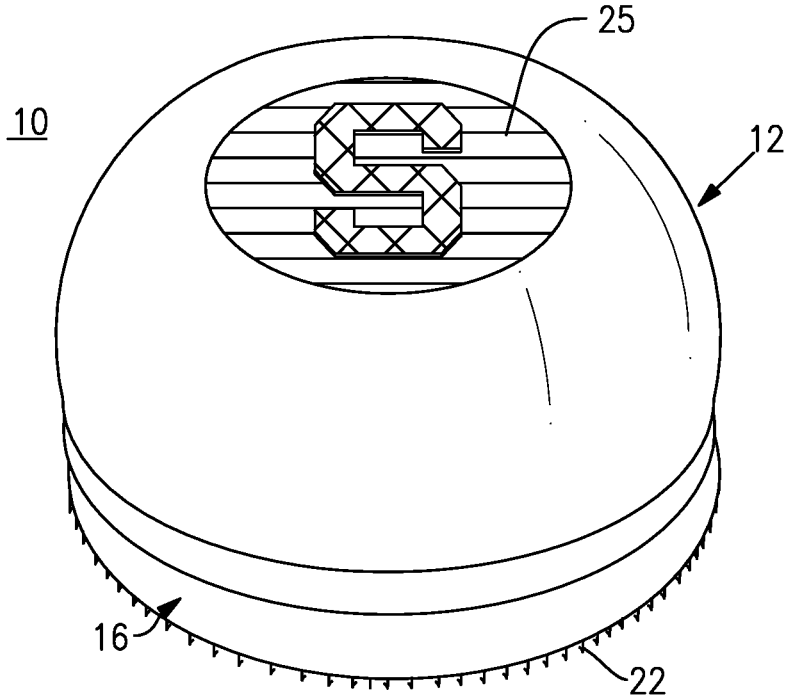
FIG. 6 is a perspective view showing an embodiment of the scrubbing tool in the form of a dome and carrying a college or university logo or other team or corporate logo.

FIG. 6 is a perspective view of a dome-shaped version of the tool, with the dome portion 12 having a top center emblem 25, here containing a school logo (a bold "S" here lined for orange on a background lined for blue). Any logo could be positioned here, e.g., a University of Michigan "M", or an Oakland Athletics stylized "A" among a multitude of possibilities.

Figure 7A:
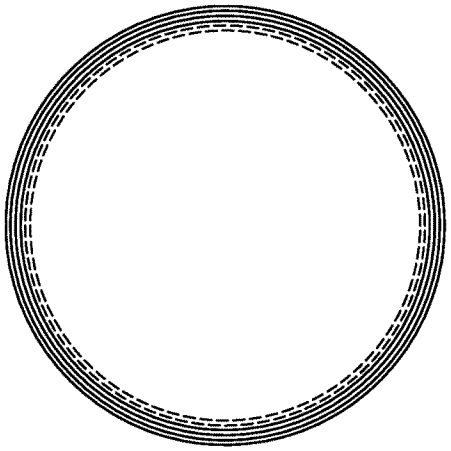
FIGS. 7A to 7D are a top plan view, perspective, side and front elevations of an embodiment in the shape of a dome.
Figure 7B:
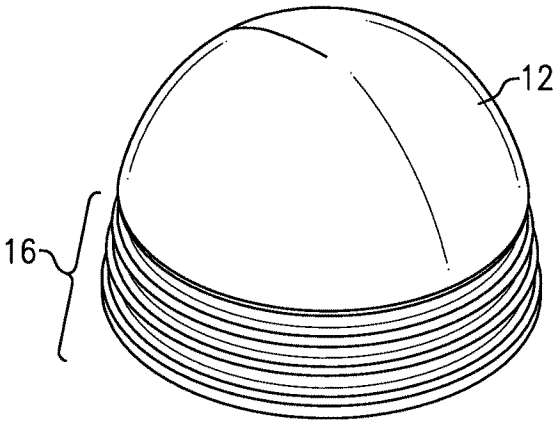
Figure 7C:
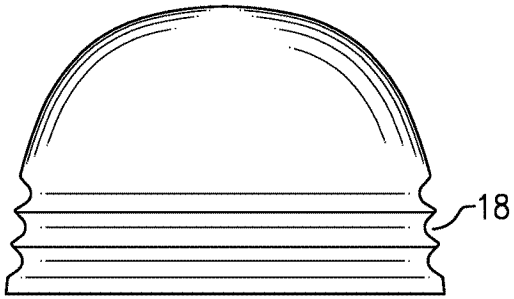
Figure 7D:
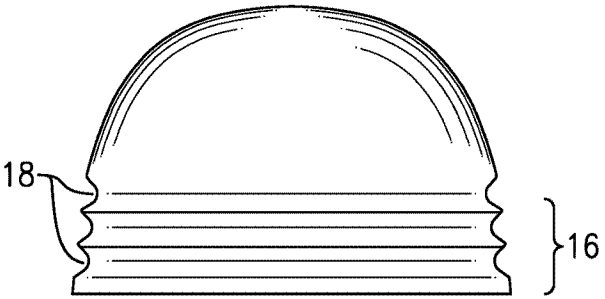

FIG. 7, composed of a plan view FIG. 7A, perspective FIG. 7B, side and front elevations FIG. 7C and FIG. 7D, illustrates the shape and overall design of the tool with a round or plain dome portion 12, as well as the generally cylindrical base portion 16 with a series of annular grooves 18.

Figure 7E:
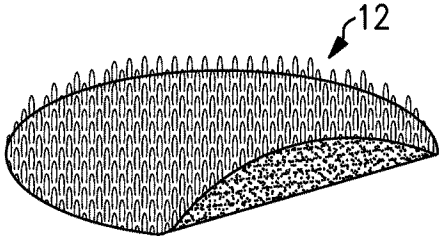
FIG. 7E illustrates an example of an abrasive sanding pad that can be employed with this embodiment of the scraper tool.

FIG. 7E here shows a sanding disk or pad 30 formed as a circle or disk of a suitable sandpaper material, with an abrasive 32 of a desired grit on its lower surface (here shown on a flap that is partly folded or turned up) and a loop material 34 on its upper surface for removably attaching onto the hook material on the bottom surface of the cylindrical base 16 of the tool. This sanding pad 30 should have the same shape and dimension as the bottom surface of the tool.

Figure 8B:
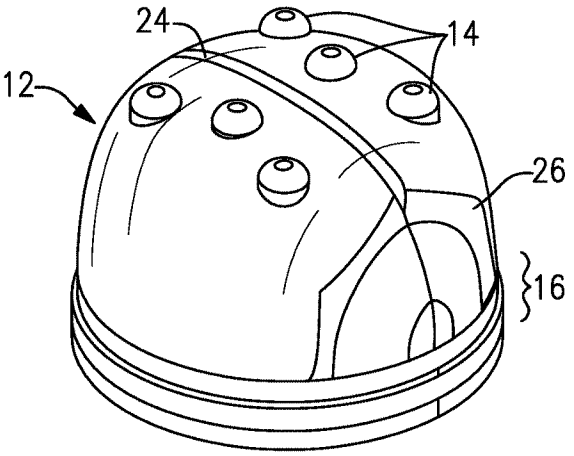
FIGS. 8A to 8D are a top plan view, perspective, side and front elevations of an embodiment in the shape of a stylized ladybug.
Figure 8D:
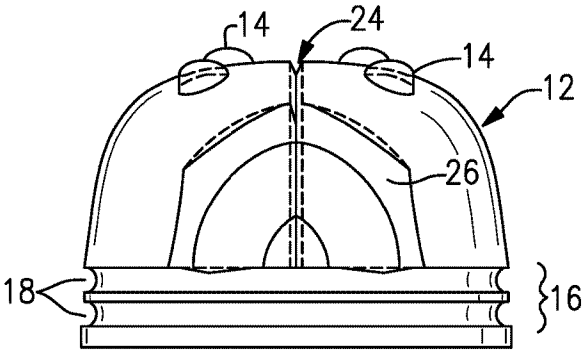
Figure 8A:
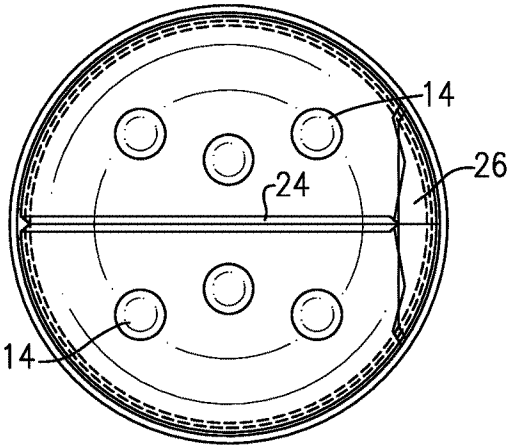
Figure 8C:
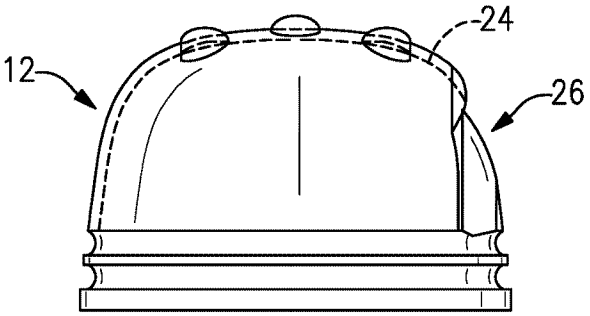

FIG. 8, composed of a plan view FIG. 8A, perspective view FIG. 8B, side and front elevations FIG. 8C and FIG. 8D, illustrates the shape and overall design of the dome portion in the shape of a ladybug or lady bird beetle. Preferably, these each are also manufactured to the same diameter of base, here a nominal 3.25 inches. As illustrated, in this embodiment there are a number of upwardly protruding buttons 14 on the upper part of shell of the ladybug design as well as an elongated V-shaped cut 24 and structure to represent the eyes and face 26 of the ladybug design.

These surface features serve to facilitate a comfortable grip for the user's hand. Here, as with the previous embodiment, the annular grooves 18 around the base portion 16 also facilitate the user's comfortable grip on the tool.

Figure 9:
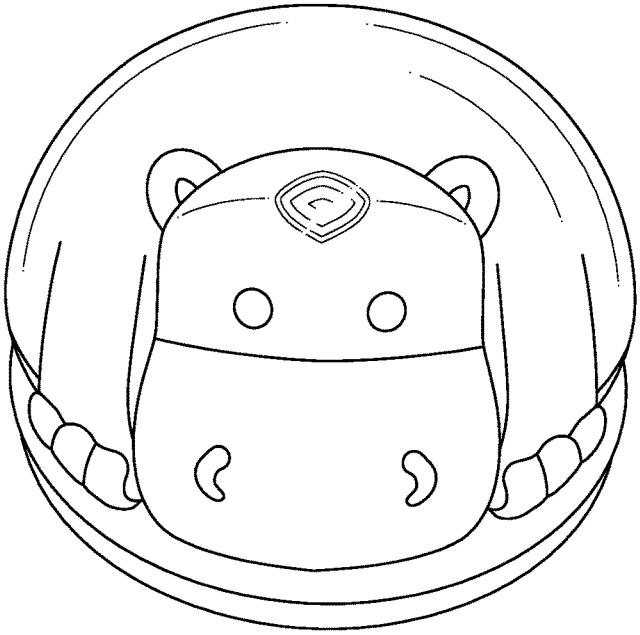
FIGS. 9 and 10 are perspective views of embodiments configured in the form of a stylized hippopotamus and pig, respectively.
Figure 10:
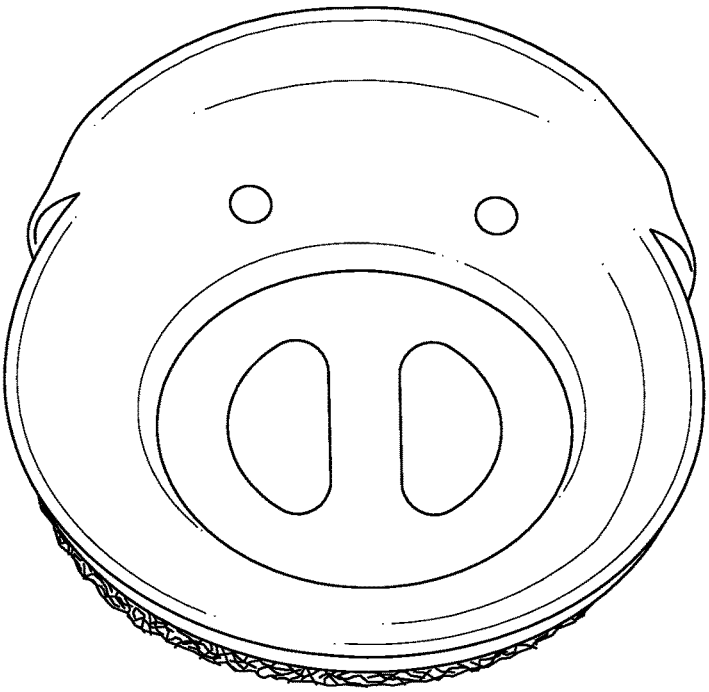

FIGS. 9 and 10 illustrate embodiments of the scraper tool in the form of a stylized hippopotamus or a stylized pig, respectively. Other animal, bird, fish, or reptile shapes can be used. The texture of these design includes features that facilitate the user gripping the tool without diminishing its comfort factor in the hand.

While this specification describes several, possible embodiments of this invention in a scrubbing tool, many other embodiments according to this invention are possible within the major principles of this invention, which are to be ascertained from a consideration of the following claims.

What is claimed is:

1. A hand-held scrubbing tool comprising a dome portion and an incorporated cylindrical base portion having a predetermined diameter and a generally circular bottom surface, and each formed of a comfortable, flexible urethane rubber material that has a durometer value of about 30 A and a hook and loop material is embedded into the material at the bottom surface of said base portion and adapted to permit a scrub pad to be secured thereto.

2. The hand-held scrubbing tool according to claim 1 wherein said base portion incorporates one or more annular grooves that encircle it.

3. The hand-held scrubbing tool according to claim 1 wherein the dome portion is in the form of a lady-bug with surface design features that facilitate gripping thereof.

4. The hand-held scrubbing tool according to claim 1 wherein the dome portion is in the shape of an orange, lemon, or lime.

5. The hand-held scrubbing tool according to claim 1 wherein the dome portion is in the form of a ladybug with posts forming wing spots protruding out from the dome portion.

6. The hand-held scrubbing tool according to claim 1 wherein the dome portion includes tactile surface elements that facilitate gripping thereof.

7. The hand-held scrubbing tool according to claim 1 further comprising one or more scrub pads formed of a fibrous material that removably attaches to the hook-and-loop material on said base portion bottom surface, each of said one or more scrub pads being dimensioned to match the size and shape of said base portion bottom surface.

8. The hand-held scrubbing tool according to claim 1 further comprising one or more sanding pads having a lower abrasive surface and an upper surface said upper surface being adapted to removably attach to the hook-and-loop material on said base portion bottom surface, and each of said one or more sanding pads being dimensioned to match the size and shape of said base portion bottom surface.

9. The hand-held scrubbing tool according to claim 1 wherein said base portion has a diameter of a nominal 3.5 inches.

10. The hand-held scrubbing tool according to claim 1 wherein said hook-and-loop material comprises a hook component thereof.

11. The hand-held scrubbing tool according to claim 1 wherein said dome portion includes a plain region thereon adapted to accept advertising or a corporate or team logo to be printed or added thereon.

* * * * *